United States Patent [19]

Stepanek

[11] Patent Number: 4,728,117

[45] Date of Patent: Mar. 1, 1988

[54] TOE IRON FOR SAFETY SKI BINDINGS

[75] Inventor: Premek Stepanek, Garmisch-Partenkirchen, Fed. Rep. of Germany

[73] Assignee: Marker Deutschland GmbH, Garmish-Partenkirchen, Fed. Rep. of Germany

[21] Appl. No.: 927,335

[22] Filed: Nov. 5, 1986

[30] Foreign Application Priority Data

Nov. 11, 1985 [DE] Fed. Rep. of Germany ..... 3539969

[51] Int. Cl.[4] ..... A63C 9/085

[52] U.S. Cl. ..... 280/625; 280/629; 280/634

[58] Field of Search ..... 280/625, 629, 634

[56] References Cited

U.S. PATENT DOCUMENTS

| | | | |
|---|---|---|---|
| 3,909,026 | 9/1974 | Salomon | 280/625 |
| 4,660,849 | 4/1987 | Sedlmair et al. | 280/625 |
| 4,685,696 | 8/1987 | Sedlmair et al. | 280/625 |

FOREIGN PATENT DOCUMENTS

| | | | |
|---|---|---|---|
| 792619 | 8/1968 | Canada | 280/626 |
| 1809889 | 6/1970 | Fed. Rep. of Germany | 280/629 |

*Primary Examiner*—David M. Mitchell
*Assistant Examiner*—Brian L. Johnson
*Attorney, Agent, or Firm*—D. Peter Hochberg; Mark M. Kusner; Walter C. Danison, Jr.

[57] ABSTRACT

A toe piece for a safety ski binding comprised of a base plate, and a pair of elongated, generally parallel side members each pivotally mounted at one end to the base plate. A connecting link having a detent depression pivotally connects the other ends of the side members to each other to form a linkage. The linkage is laterally movable about the pivotably mounted ends of the side members relative to the base plate. A pair of side jaws for laterally holding the sole of the ski boot are pivotally connected to the connecting link and are movable between a holding position and a release position. A lever is positioned between the side jaws and is pivotally connected to the connecting link. The lever is movable between a holding position and a release position, and includes a cam surface comprised of an intermediate cam portion corresponding to the detent depression on the connecting link and end cam portions projecting beyond the edge surface of the connecting link, and end surfaces operatively engaging the jaws for locking the jaws in a holding position when the lever is in the holding position. A detent roller is biased against the detent depression and intermediate cam portion for centering the linkage and for maintaining the lever in the holding position.

4 Claims, 4 Drawing Figures

TOE IRON FOR SAFETY SKI BINDINGS

FIELD OF THE INVENTION

The present invention relates to ski-bindings, and more specifically to a front toe piece for a safety ski binding which is pivotable in a lateral direction against a biasing force when excessive side forces occur.

BACKGROUND OF THE INVENTION

Front toe pieces of the aforementioned type are known, e.g., DE No. 33 43 943 A1 discloses a front piece for safety ski bindings wherein the internal friction is extremely low and the restoring behavior is improved over the device known heretofore. In general, with front pieces of the kind involved herein the side jaws include extensions which are coupled by means of two connecting levers and a two-armed member which holds the side jaws in normal position constitutes a locking member and is operatively connected to the connecting levers. At least one separate control member, which is not associated with the four-bar linkage, is provided for the control of the two-armed levers. In this respect, such front pieces are comprised of a relatively large number of parts so that they are liable to be deranged and cannot be manufactured at low cost.

SUMMARY OF THE INVENTION

It is an object of the present invention to simplify the structure of front toe pieces of the type heretofore described by the elimination of previously existing parts.

It is another object of the present invention to provide a front toe piece as described above wherein the front toe piece will be less liable to be deranged.

In accordance with the present invention there is provided a toe piece for holding a ski boot in a safety ski binding wherein the toe piece is pivotable laterally against a biasing force when excessive side forces occur. The toe piece is comprised of a base plate, and a pair of elongated, generally parallel side members each pivotally mounted at one end to the base plate. A connecting link having a detent depression pivotally connects the other ends of the side members to each other to form a linkage. The linkage is laterally movable about the pivotably mounted ends of the side members relative to the base plate. A pair of side jaws for laterally holding the sole of the ski boot are pivotally associated with the connecting link and are movable between a holding position and a release position. A lever is positioned between the side jaws and is pivotally connected to the connecting link. The lever is movable between a holding position and a release position, and includes a cam surface comprised of an intermediate cam portion corresponding to the detent depression on the connecting link and end cam portions projecting beyond the edge surface of the connecting link, and end surfaces operatively engaging the jaws for locking the jaws in a holding position when the lever is in the holding position. Detent means are provided biased against the detent depression and intermediate cam portion for centering the linkage and for maintaining the lever in the holding position. The detent means engages the end cam portion of the lever when the linkage is laterally moved a predetermined distance beyond the center point and shifts the lever to a releasing position.

The present invention thus provides a front toe piece wherein a separate control member is no longer required. In operation when excessive side forces occur, the toe piece will pivot laterally. When the connecting link has moved a predetermined distance, the protruding portion of the lever will strike against the detent roller. The lever will be pivotally moved by the latter toward the boot so that the other end of the lever is disengaged from the extension of the leading side jaw and the latter can now perform an outward pivotal movement under the load applied by the boot and can release the boot. In this respect, the free ends of the lever constitute locking surfaces which engage the extensions of the side jaws.

In accordance with another aspect of the present invention, the locking surfaces of the lever terminate in sharp edges and the adjoining end portion is concavely curved. This portion of the lever serves as a restoring surface for the extension of the associated side jaw to return the jaw to it holding position when the lateral force is removed.

BRIEF DESCRIPTION OF THE DRAWINGS

The invention may take physical form in certain parts and arrangement of parts, a preferred embodiment of which will be described in detail in this specification and illustrated in the accompanying drawings which form a part hereof and wherein.

DETAILED DESCRIPTION OF PREFERRED EMBODIMENT

Figure 1:
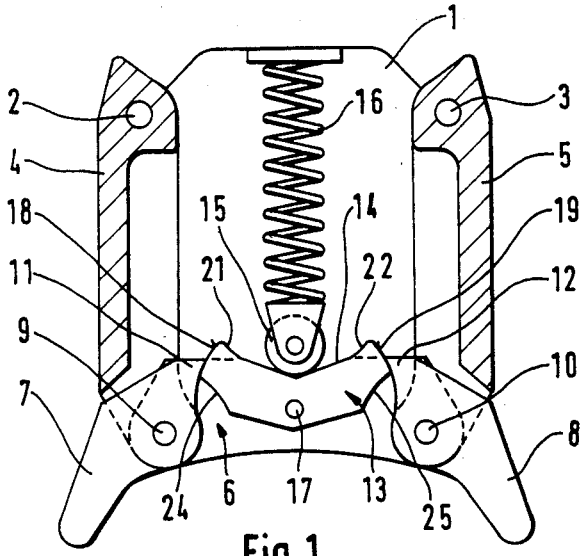
FIG. 1 is a schematic, partially sectional view of a front piece for a safety ski binding according to the present invention, showing the essential members of such piece in their normal position.

Referring now to the drawings wherein the showing is for the purpose of illustrating a preferred embodiment of the invention only and not for the purpose of limiting same, FIG. 1 illustrates an embodiment of a toe holder according to the present invention. A baseplate 1, which is to be fixed to the ski in the usual manner, carries a linkage on two pivots 2, 3, which extend at right angles to the plane of the ski. The linkage is comprised of side members 4 and 5, and a connecting link 6. Connecting link 6 serves as a supporting member for two side jaws 7, 8, which are pivotally connected to side members 4, 5 and link 6 by means of two pivot pins 9, 10. Side jaws 7, 8 are provided to support the sole of a ski boot (not shown) laterally and forwardly. Jaws 7, 8 include arms 11, 12 which extend inwardly beyond pivot pins 9, 10. The free ends of the arms 11, 12 are dimensioned to normally engage a two-armed lever 13, which is pivotally connected to connecting link 6 by pin 17 which is parallel to pivot pins 9, 10 of side jaws 7, 8. As a result, side jaws 7, 8 are held in a first normal position relative to connecting link 6.

Figure 2:
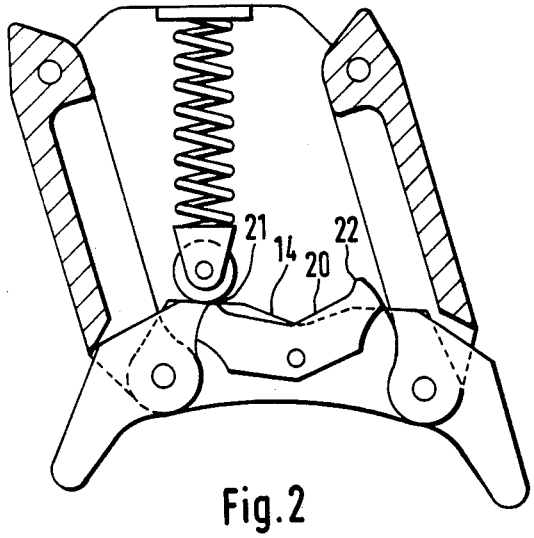
FIG. 2 is a view of the front piece illustrated in FIG. 1 showing the front piece pivoted to the point of release of the leading side jaw.

As best seen in FIG. 2, the connecting link 6 includes a detent depression 14 on one side thereof. A detent roller 15, biased by a helical compression spring 16 which bears on the baseplate 1, is provided to engage detent 14. Detent roller 15 is operative to normally hold connecting link 6 and the linkage in the position shown in FIG. 1. Detent roller 15 is guided relative to the baseplate by means not shown. In a manner which is conventionally known, and for that reason is not described in more detail, the detent resistance can be varied by changing the initial stress of helical compression spring 16.

Lever 13, which is pivotally connected to the connecting link 6 by the pin 17, includes arms 11, 12, each of which is a mirror image of the other. The ends of arms 11, 12 define lever locking surfaces 18, 19 which operatively engage side jaws 7, 8 respectively. Between the locking surfaces 18, 19, the lever 13 includes a concave cam surface having end portions 21, 22 separated by an intermediate portion 20. Intermediate portion 20 corresponds to detent depression 14 formed on connecting link 6. As best seen in FIG. 1, portions 21, 22 protrude or project beyond the edge of connecting link 6.

Locking surfaces 18, 19 of the lever 13 define the locking side thereof and are outwardly curved about pivot 17. Adjacent locking surfaces 18, 19 are surfaces 24, 25 which are concavely curved inwardly and serve as restoring surfaces for the arms 11, 12 respectively.

With respect to the operation of the present invention, the several parts of the toe iron normally assume the position shown in FIG. 1. When a force exceeding the initial stress of helical compression spring 16 is transmitted, e.g., to the side jaw 8, the linkage will pivotally move from the illustrated position to the right. During such pivotal movement side jaws 7, 8 do not move relative to connecting link 6 because of engagement with surfaces 18, 19 of lever 13. If the force decreases, the linkage is restored to its initial position by detent roller 15, which has run up on the side face of the detent depression 14.

Figure 3:
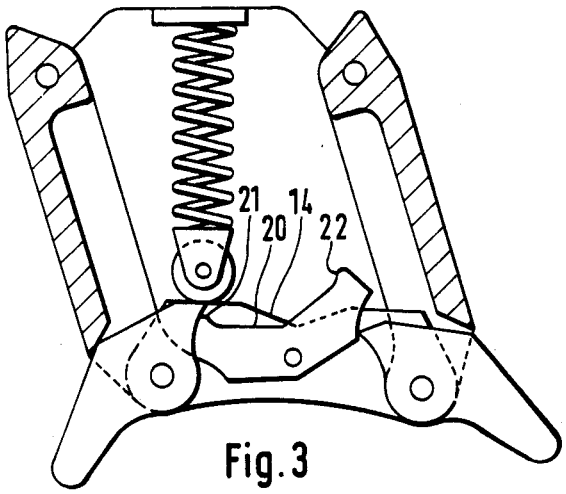
FIG. 3 is a view of the front piece after the side jaw has been swung out.

But when the force applied is so strong that the pivotal movement performed by the linkage causes detent roller 15 to move beyond detent depression 14, detent roller 15 will roll upon the flat portion of connecting link 6 and will strike the outer portion 21 of the cam surface of the lever 13 and will impart to the latter a pivotal movement in the counterclockwise direction until the end of arm 12 of side jaw 8 disengages locking surface 19 of lever 13, as shown in FIG. 2. The force transmitted by the sole of the boot to side jaw 8 will now impart to the latter a pivotal movement about pivot pin 10 to the position shown in FIG. 3. In such position, the boot can move away from the toe iron. A comparison between FIGS. 2 and 3 illustrates how lever 13 is pivotally moved further away from side jaw 8.

Figure 4:
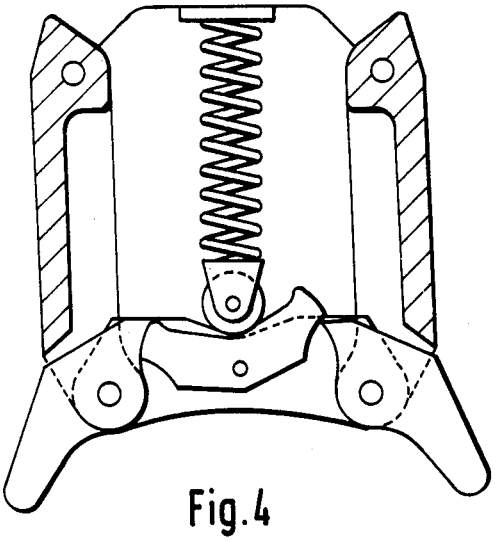
FIG. 4 is a view showing the front piece shortly before it has resumed its normal position.

When the boot has been released and the side jaw has been relieved, the linkage is restored under the action of detent roller 15. Shortly before the linkage reaches its normal position, detent roller 15 strikes against that portion of the lever 13 which protrudes from detent depression 14 of connecting link 6 and lever 13 is thus pivotally moved in the clockwise direction as seen in FIG. 4. End portion 25 of the lever pivotally returns side jaw 8 about pivot pin 10 until the normal position shown in FIG. 1 has been reached.

The invention has been described with respect to a preferred embodiment. Modifications and alterations will occur to others upon their reading and understanding of this specification. It is intended that all such modifications and alterations be included insofar as they come within the scope of the invention as claimed or the equivalents thereof.

Having thus described the invention, it is claimed:

1. A toe piece for holding a ski boot in a safety ski binding wherein said toe piece is pivotable laterally against a biasing force when excessive side forces occur, said toe piece comprising:

a base plate;

a pair of elongated, generally parallel side members, each pivotally mounted at one end to said base plate;

a connecting link having an elongated edge surface with a detent depression therein, said link pivotally connecting the other ends of said side members to each other to form a linkage which is laterally movable relative to said base plate about said pivotally mounted ends of said side members;

a pair of side jaws for laterally holding the sole of said boot, said jaws pivotally connected to said connecting link on opposite sides of said depression and movable between a ski boot holding position and a ski boot release position;

a lever including:

a cam surface comprised of an intermediate cam portion corresponding dimensionally to said detent depression and end cam portions protruding beyond said intermediate portion and, end surfaces dimensioned to engage said side jaws, said lever being pivotally connected to said link about an axis centrally disposed between said side jaws wherein said end surfaces of said lever are in operative engagement with said side jaws and said intermediate cam portion on said lever is generally adjacent and aligned with said detent depression with said end cam portions projecting beyond said edge surface, said lever being movable between a first jaw holding position where said end surfaces of said lever engage said side jaws and maintain said jaws in said holding position and a second jaw releasing position; and, detent means biased into engagement with said detent depression and said intermediate cam portion, said detent means urging said linkage to a central position relative to said base plate and said lever to said jaw holding position, said detent means engaging one of said end cam portions of said lever when said linkage is laterally moved a predetermined distance from said central position wherein said lever is shifted to said jaw release position thereby releasing the jaw in the direction of movement of the linkage.

2. A toe piece as defined in claim 1 wherein said side jaws include extensions which engage said end surfaces of said lever.

3. A toe piece as defined in claim 1 wherein said lever includes arm portions which define said cam surface and said end surfaces, each arm portion being a mirror image of the other.

4. A toe piece as defined in claim 2 wherein said end surfaces of said lever are curved about said axis and terminate in sharp edges, said lever further including releasing surfaces adjacent said end surfaces, said releasing surfaces defining guide surfaces for said extension of said jaws to return said jaws to said holding position when said detent means returns said linkage to a central position.

* * * * *